US007526418B2

(12) United States Patent
Pita et al.

(10) Patent No.: US 7,526,418 B2
(45) Date of Patent: Apr. 28, 2009

(54) HIGHLY-PARALLEL, IMPLICIT COMPOSITIONAL RESERVOIR SIMULATOR FOR MULTI-MILLION-CELL MODELS

(75) Inventors: Jorge A. Pita, Dhahran (SA); James C. T. Tan, Dhahran (SA); Larry S. Fung, Dhahran (SA); Ali H. Dogru, Dhahran (SA)

(73) Assignee: Saudi Arabian Oil Company (SA)

( * ) Notice: Subject to any disclaimer, the term of this patent is extended or adjusted under 35 U.S.C. 154(b) by 581 days.

(21) Appl. No.: 10/916,851

(22) Filed: Aug. 12, 2004

(65) Prior Publication Data

US 2006/0036418 A1 Feb. 16, 2006

(51) Int. Cl.
*G06G 7/48* (2006.01)

(52) U.S. Cl. ..... 703/10; 703/9; 702/12; 702/13

(58) Field of Classification Search ..... 703/9, 703/10; 702/6, 11–13; 166/252.2
See application file for complete search history.

(56) References Cited

U.S. PATENT DOCUMENTS

| | | | | |
|---|---|---|---|---|
| 5,710,726 | A | 1/1998 | Rowney | |
| 6,052,520 | A | 4/2000 | Watts, III | |
| 6,826,520 | B1 * | 11/2004 | Khan et al. | 703/10 |
| 6,928,399 | B1 * | 8/2005 | Watts et al. | 703/2 |
| 7,006,959 | B1 * | 2/2006 | Huh et al. | 703/10 |
| 2002/0177986 | A1 | 11/2002 | Moeckel et al. | |

OTHER PUBLICATIONS

Abate et al., "Parallel Compositional Reservoir Simulation on a Cluster of PCs", The International Journal of High Performance Computing Applications, 1998.*

Wu et al., "An Efficient Parallel-Computing Method for Modeling Nonisothermal Multiphase Flow and Multicomponent Transport in Porous and Fractured Media", Advance in Water Resources, vol. 25, Issue 3, Mar. 2002, pp. 243-261.*

Coats, Keith H., "An Equation of State Compositional Model" SPE 8284, Sep. 23-26, 1979, Dallas, TX.

Coats, Keith H., "Compositional and Black Oil Reservoir Simulation" SPE, Aug. 1998, pp. 372-379.

Wang, P., "A Fully Implicit Parallel EOS Compositional Simulator for Large Scale Reservoir Simulation", SPE 51885, Feb. 14-17, 1999, Houston, TX, pp. 1-9.

Wang, P., "Proper Use of Equations of State for Compositional Reservoir Simulation", SPE Distinguished Author Series, Paper, SPE 69071, Jul. 2001, pp. 74-80.

Stackel, Andrew W., "An Example Approach to Predictive Well Management in Reservoir Simulation", SPE 1722, Apr. 1981, Denver, CO, pp, 311-318.

Wijesinghe, A.M., "A Comprehensive Well Management Program for Black Oil Reservoir Simulation", SPE 12260, Nov. 15-18, 1983, San Francisco, pp. 267-280.

Wallace, D.J., "A Reservoir Simulation Model With Platform Production/Injection Constraints for Development Planning of Volatile Oil Reservoirs" SPE 12261, Nov. 15-18, 1983, CA.

(Continued)

*Primary Examiner*—Kamini S Shah
*Assistant Examiner*—Herng-Der Day
(74) *Attorney, Agent, or Firm*—Bracewell & Giuliani LLP

(57) ABSTRACT

A fully-parallelized, highly-efficient compositional implicit hydrocarbon reservoir simulator is provided. The simulator is capable of solving giant reservoir models, of the type frequently encountered in the Middle East and elsewhere in the world, with fast turnaround time. The simulator may be implemented in a variety of computer platforms ranging from shared-memory and distributed-memory supercomputers to commercial and self-made clusters of personal computers. The performance capabilities enable analysis of reservoir models in full detail, using both fine geological characterization and detailed individual definition of the hydrocarbon components present in the reservoir fluids.

17 Claims, 14 Drawing Sheets
(9 of 14 Drawing Sheet(s) Filed in Color)

OTHER PUBLICATIONS

Mohamed, Diamond, "An Efficient Reservoir-Coupled Gas Gathering System Simulator" SPE 8333, Sep. 23-26, Dallas, pp. 1-6 1979.

Mrosovsky I. "The Construction of A Large Field Simulator on a Vector Computer" SPE 8330, Sep. 23-29, 1979, Dallas, pp. 1-11.

Dogru, A.H., et al, "A Massively Parallel Reservoir Simulator for Large Scale Reservoir Simulation," SPE 51886, SPE Reservoir Simulation Symposium, pp. 1-11, Houston, Feb. '99.

Dogru, A.H., Dreiman, et al, "Simulation of Super K Behavior in Ghawar by a Multi-Million Cell Parallel Simulator," SPE 68066, Middle East Oil Show, pp. 1-10 Bahrain Mar. 2001.

M.L. Litvak, " New Procedure for the Phase-Equilibrium Computations in the Compositional Reservoir Simulator", SPE Advanced Technology Series, Feb. 28, 1993, pp. 113-121.

A.H. Dogru, et al., "A Parallel Reservoir Simulator for Large-Scale Reservior Simulation", SPE Advance Technology Series, Feb. 2002, pp. 11-23.

A.H. Dogru. "Megacell Reservior Simulation", SPE Advanced Technology Series, May 5, 2000, pp. 54-60, vol. 52, No. 5, United States of America.

* cited by examiner

180

HIGHLY-PARALLEL, IMPLICIT COMPOSITIONAL RESERVOIR SIMULATOR FOR MULTI-MILLION-CELL MODELS

BACKGROUND OF THE INVENTION

1. Field of the Invention

The present invention relates to computerized simulation of hydrocarbon reservoirs in the earth, and in particular to simulation of historical performance and forecasting of production from such reservoirs.

2. Description of the Related Art

So far as is known, the development of compositional reservoir simulators in the industry has been restricted to models discretized with a relatively small number of cells (of the order of 100,000). Models of this type may have provided adequate numerical resolution for small to medium size fields, but become too coarse for giant oil and gas fields of the type encountered in the Middle East and some other areas of the world, e.g., Kazakhstan, Mexico, North Sea, Russia, China, Africa and the United States. As a result of this, sufficient cell resolution was only possible at the expense of dividing the reservoir model into sectors. This, however artificially imposed flow boundaries that could distort a true or accurate solution.

Another standard practice in the industry has been that of "upscaling" detailed geological models. "Upscaling" is a process that coarsened the fine-cell geological discretization into computational cells coarse enough to produce reservoir models of more manageable size (typically in the order of 100,000-cells). Such coarsening inevitably introduced an averaging or smoothing of the reservoir properties from a geological resolution grid of tens of meters into a much coarser grid of several hundred meters. This practice made it virtually impossible to obtain an accurate solution for giant reservoirs without excessive numerical dispersion. As a result, an undesirable effect was present—the geological resolution was being compromised at the expense of better fluid characterization.

Yet another compromise undertaken by the industry over the years has been that of performing a "semi-compositional" simulation, by which an equation of state program was used to provide compositional properties to a black-oil simulator while only solving the flow equations for three components (oil, water and gas). This approximation simplified the heavy computational burden at the expense of limiting itself to those problems where compositional changes in the reservoir were small and did not require full tracking of the flow of individual components, such as in U.S. Pat. No. 5,710,726.

SUMMARY OF THE INVENTION

Briefly, the present invention provides a new and improved method of computerized simulation of the fluid component composition of a subsurface reservoir partitioned into a number of cells by a set of computer processing steps. The computer processing steps include forming a postulated measure of equilibrium compositions for the component fluids in a cell. The computer processing steps also include forming a postulated measure of species balance for the component fluids in the cell. If the measures are not within the specified level of prescribed tolerance, computer processing continues. The computer processing steps are repeated with adjusted values of the postulated measures until the measures are within the specified level of prescribed tolerance. When this is determined to be the case, the measures obtained for that time of interest are stored, and the time of interest is adjusted by an increment so that the processing steps may proceed for the new time of interest. The processing sequence described above continues for the entire simulation until a complete compositional solution of the subsurface reservoir over a projected period of time is obtained.

The computer processing steps according to the present invention are suitable for performance in a variety of computer platforms, such as shared-memory computers, distributed memory computers or personal computer (PC) clusters, which permits parallelization of computer processing and reduction of computer processing time.

The results of these two computer processing steps are then used in determining if the postulated measure of equilibrium compositions and species balance for the component fluids in the cell are within a level of user-prescribed tolerances.

And all those qualities and objectives that will be evident when carrying out a description of the invention herein, supported in the illustrated models.

To better understand the characteristics of the invention, the description herein is attached, as an integral part of the same, with drawings to illustrate, but not limited to that, described as follows.

BRIEF DESCRIPTION OF THE DRAWINGS

The patent application file contains at least one drawing executed in color. Copies of this patent application publication with color drawings will be provided by the Office upon request and payment of necessary fee.

A better understanding of the present invention can be obtained when the detailed description set forth below is reviewed in conjunction with the accompanying drawings, in which:

FIGS. 1, 1A, 1B and 1C are isometric views of a compositional model of a giant subsurface hydrocarbon reservoir for which measurements are simulated according to the present invention.

Figure 1A:
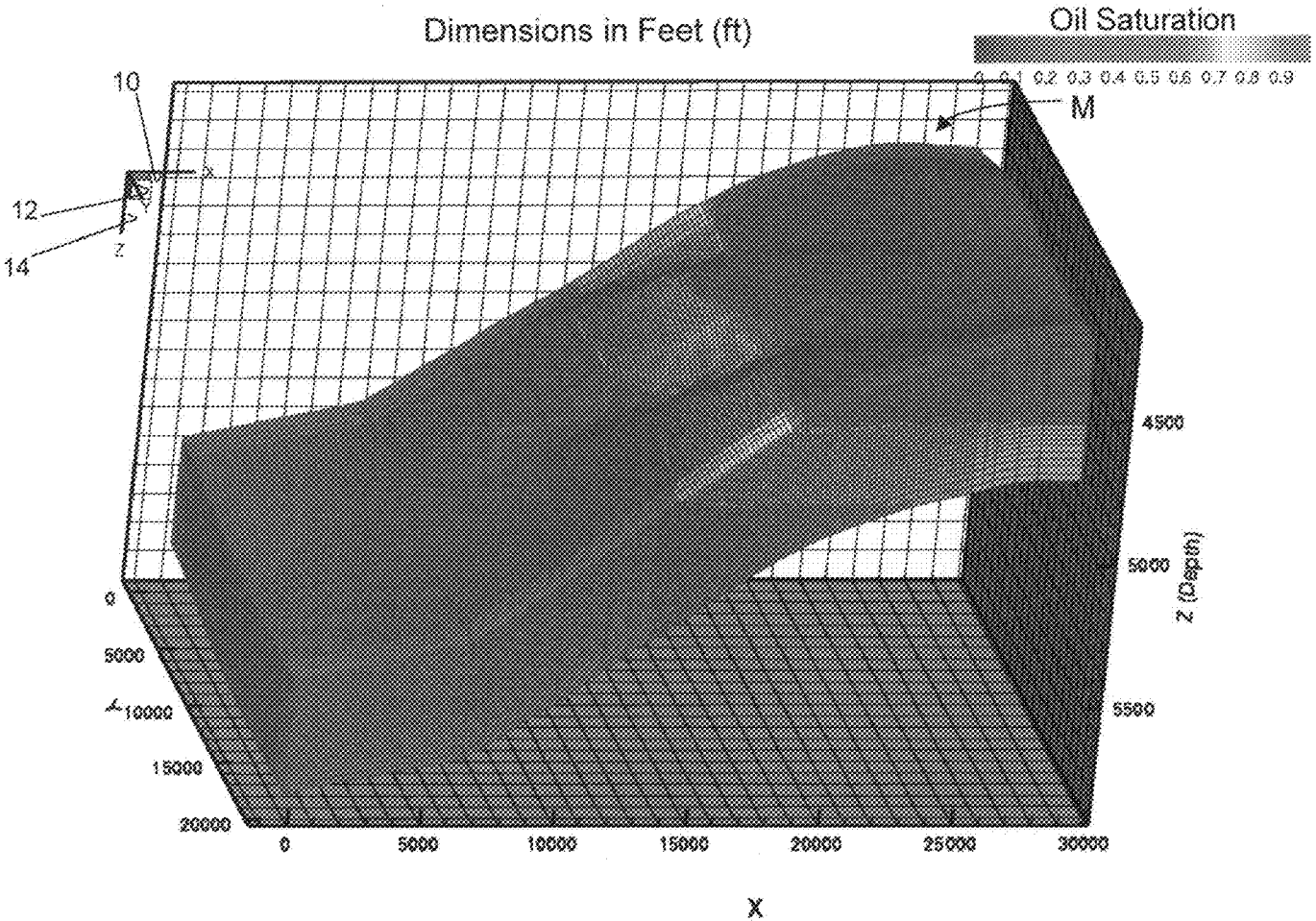

To better understand the invention, we shall carry out the detailed description of some of the modalities of the same, shown in the drawings with illustrative but not limited purposes, attached to the description herein.

DETAILED DESCRIPTION OF THE PREFERRED EMBODIMENTS

A. Introduction and Parameter Definitions

Figure 1B:
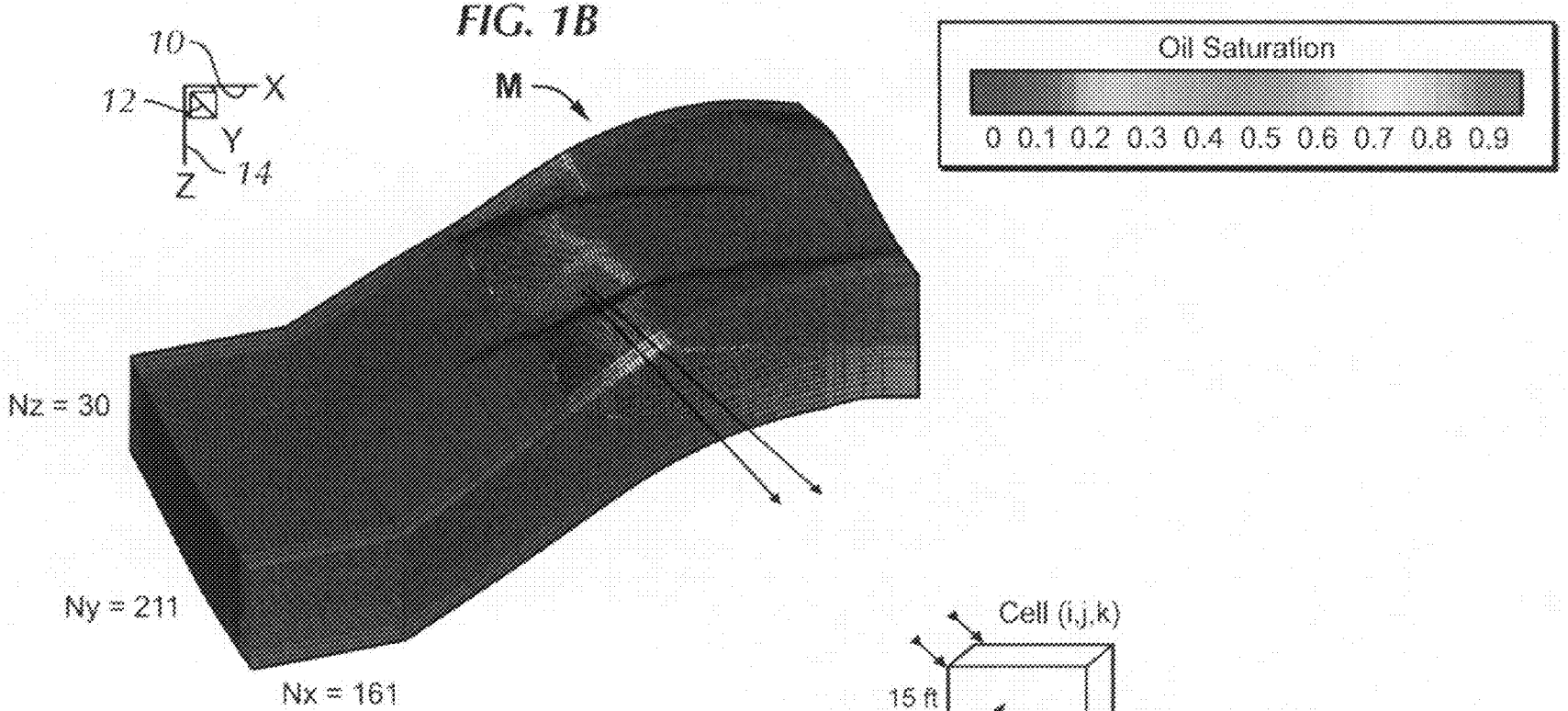
Figure 1C:
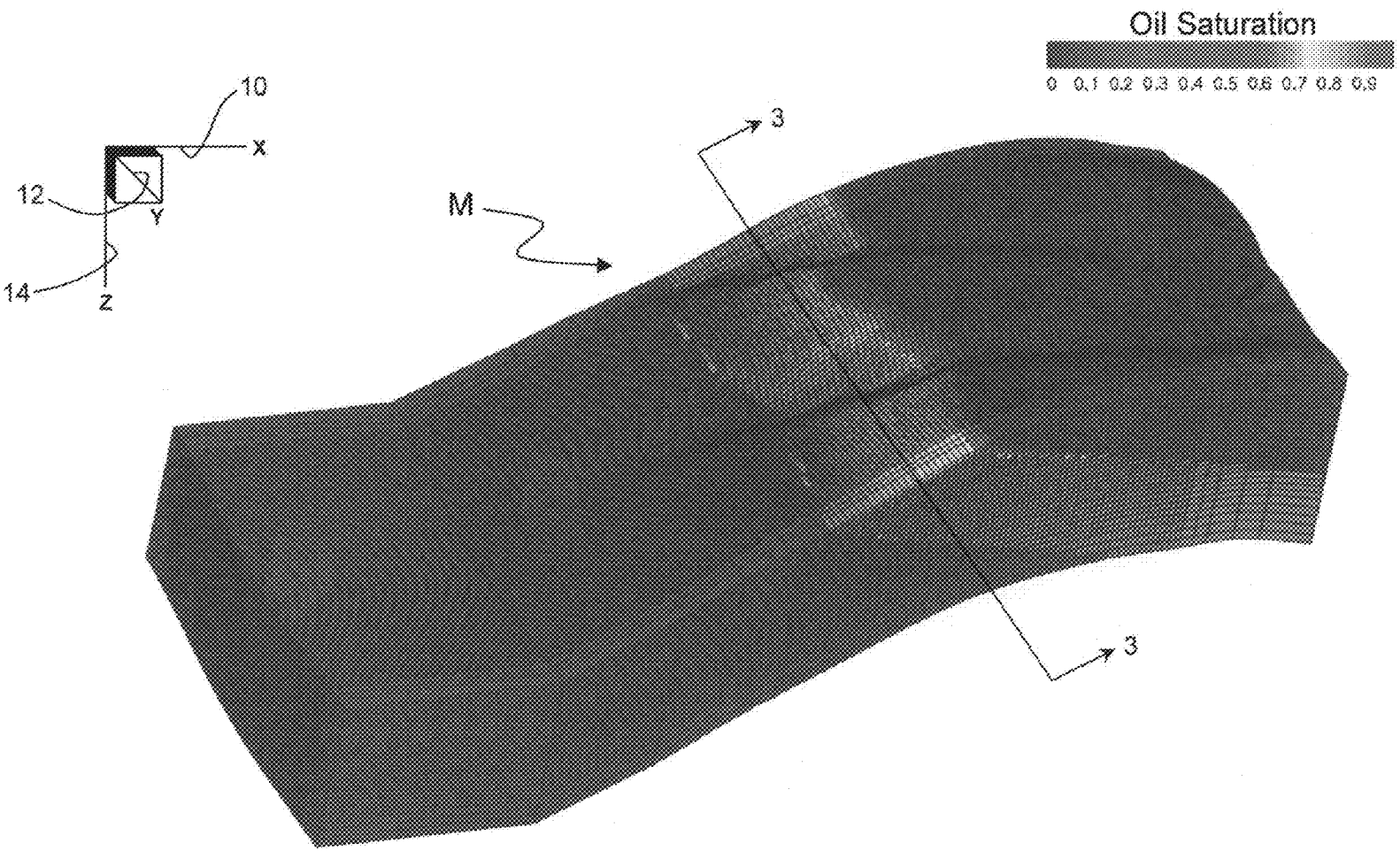

In the drawings, the letter M (FIGS. 1A, 1B and 1C) designates a compositional model of a subsurface hydrocarbon reservoir for which measurements of interest for production purposes are simulated according to the present invention. The results obtained are thus available and used for simulation of historical performance and for forecasting of production from the reservoir. The model M in FIGS. 1A, 1B and 1C is a model of the same structure. The different figures are presented so that features of interest may be more clearly depicted. In each of FIGS. 1A, 1B and 1C, a display of oil saturation ranging from 0.0 to over 0.9 is superimposed.

The actual reservoir from which the model M is obtained is one which is characterized by those in the art as a giant reservoir. The reservoir is approximately some six miles as indicated in one lateral (or x) dimension as indicated at 10 in FIG. 1A and some four miles in another lateral (or y) dimension as indicated at 12 in FIG. 1A and some five hundred feet or so in depth (or z). The model M thus simulates a reservoir with a volume of on the order of three hundred billion cubic feet.

Figure 2:
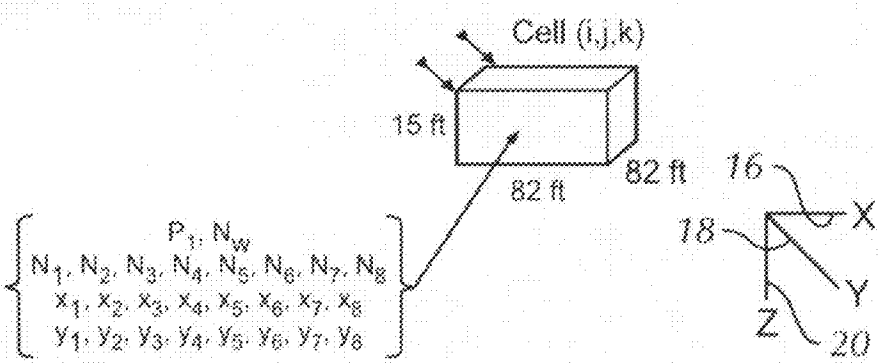
FIG. 2 is an enlarged isometric view of one individual cell from the subsurface hydrocarbon reservoir model of FIG. 1B.

The model M is partitioned into a number of cells of suitable dimensions, one of which from FIG. 1B is exemplified in enlarged form at C (FIG. 2). In the embodiment described, the cells are eighty or so feet along each of the lateral (x and y) dimensions as indicated at 16 and 18 and fifteen or so feet in depth (z) as indicated at 20. The model M of FIG. 1 is thus composed of 1,019,130 cells having the dimension shown for the cell C of FIG. 2.

In the cells C of the model M, a fluid pressure is present, as well as moles $N_i$ of various components of a compositional fluid. As shown in FIG. 2, there are eight possible component hydrocarbon fluids having moles $N_1$ through $N_8$, inclusive, as well as water having moles $N_w$ possible present as component fluids in the compositional fluid of the cells C. It should be understood that eight hydrocarbon fluids is given by way of example and other numbers could be used, if desired.

Each individual cell C is located at a number co-ordinate location i, j, k in the x, y, z co-ordinate system, as shown in FIG. 2 at co-ordinates x=i; y=j; and z=k, and each of the eight possible fluid components $N_i$ in cell C at location (i,j,k) has a possible mole fraction $x_i$ in the liquid phase and a possible mole fraction $y_i$ in the gas phase.

It can thus be appreciated that the number of cells and components of a compositional fluid in the model M are vastly beyond the processing capabilities of compositional reservoir simulators described above, and that the reservoir would be considered giant. Thus, simulation of a reservoir of this size was, so far as is known, possible only by simplifications or assumptions which would compromise the accuracy of the simulation results, as has also been described above.

With the present invention, a fully-parallelized, highly-efficient compositional implicit hydrocarbon reservoir simulator is provided. The simulator is capable of solving giant reservoir models, of the type frequently encountered in the Middle East and elsewhere in the world, with fast turnaround time. The simulator may be implemented in a variety of computer platforms ranging from shared-memory and distributed-memory supercomputers to commercial and self-made clusters of personal computers. The performance capabilities enable analysis of reservoir models in full detail, using both fine geological characterization and detailed individual definition of the hydrocarbon components present in the reservoir fluids.

In connection with the processing according to the present invention, a number of parameters and variables relating to the pressure, flow and other measurements (whether historical or forecast) are involved. For ease of reference, the various parameters and variables for the purposes of the present invention are defined as follows:

$A_i$=mixing rule for binary interaction coefficients in equation of state (EOS)

$a_i$=first equation of state (EOS) parameter for component i $a_m$=mixing rule for "a" parameter in EOS $b_i$=second equation of state (EOS) parameter for component i $b_m$=mixing rule for "b" parameter in EOS $b_1$, $b_2$, $b_3$=Canonical equation of state (EOS) parameters c=shift parameter in EOS K=rock permeability $k_{rj}$=relative permeability of phase j (j can be "o" for oil, "g" for gas or "w" for water)

$N_i$=Moles of hydrocarbon component i $N_w$=Moles of water

P=reservoir pressure $P_{ci}$=critical pressure for component i $q_i$=flow rate sink/source (from the wells) for component i $q_w$=flow rate sink/source (from the wells) for water R=universal gas constant $s_i$=individual shift parameter for component i T=reservoir temperature $T_{ci}$=critical temperature for component i $T_{ri}$=reduced temperature ($T_{ri}=T/T_{ci}$) for component i t=time of reservoir production being simulated V=volume of fluid in equation of state $x_i$=Mole fraction of component i in the liquid phase $y_i$=Mole fraction of component i in the gas phase Z=fluid compressibility factor (=PV/RT)

z=reservoir depth

Greek letter variables:

$\delta_{ij}$=binary interaction coefficient between any two components i and j $\phi_i$=fugacity coefficient for component i $\omega_i$=accentric factor for component i $\rho_j$=Molar density of phase j (j can be "o" for oil, "g" for gas or "w" for water)

$\gamma_j$=Mass density of phase j (j can be "o" for oil, "g" for gas or "w" for water)

$\mu_j$=Viscosity of phase j (j can be "o" for oil, "g" for gas or "w" for water)

$\xi_{ij}$=Mole fraction of component i in phase j

B. Definitions

The present invention is a fully-parallelized, highly-efficient implicit compositional reservoir simulator capable of solving giant reservoir models frequently encountered in the Middle East and elsewhere in the world. It represents an implicit compositional model where the solution of each component is fully coupled to other simulation variables. Because of its implicit formulation, numerical stability is unconditional and not subject to specific restrictions on the time step size that can be taken during simulation. Certain terms are defined below with reference to the present invention.

By highly-parallelized it is meant that the present invention uses a highly-efficient mixed-paradigm (MPI and OpenMP) parallel programming model for use in both shared and distributed memory parallel computers.

By highly efficient it is meant that the present invention has a parallel design that maximizes the utilization of each processor's floating-point capabilities while minimizing communication between processors that would tend to reduce overall efficiency. The result of this high efficiency is attaining very high scalability as the number of processors is increased and providing fast simulation turnaround. By implicit it is meant that the present invention solves the fluid flow equations in the reservoir using a fully coupled implicit time-stepping scheme, without lagging any of the reservoir variables to make sure that the algorithm stability is fully unconditional and independent of the time-step size taken.

By full compositional model it is meant that the present invention solves for and tracks the flow of individual hydrocarbon species in the oil and gas phases throughout the reservoir, taking into account effects caused by high-speed gas flows such as non-Darcy flow effects in the well bore (through the use of rate-dependent skin) and in the reservoir (by solving the Forchheimer equation).

By giant reservoir models it is meant models having millions of computational cells that are needed to discretize large reservoirs into an adequate mesh with fine spatial resolution to guarantee high numerical, geological and engineering accuracy, including provision of proper handling of the thermodynamics (i.e. average pressure in coarse grid-blocks cannot trigger phase changes correctly). Giant reservoirs of oil and gas fields are found in the Middle East, Former Soviet Union, United States, Mexico, North Sea, Africa, China and Indonesia.

The goal of the present invention hinges precisely on removing this serious numerically-dispersive limitation by solving the reservoir flow at generally the same resolution as provided by current state-of-the-art reservoir characterization and seismic inversion technologies, while at the same time avoiding any subdivision of the model into sectors with the attendant errors introduced by artificial flow boundaries and without compromising the number of hydrocarbon components needed for accurate fluid property characterization.

C. Three-Dimensional Reservoir Fluid Flow Modeling

The present invention is accomplished by a series of computer processing steps, by the use of which a three-dimensional solution of fluid flow in oil and gas reservoirs at the individual hydrocarbon-component level is obtained.

According to the present invention, with computer data processing, a system of non-linear, highly coupled partial differential equations with nonlinear constraints is solved, representing the transient change in fluid compositions (i.e. saturations) and pressure in every cell C of the discretized finite-difference domain. The saturation in every cell C can change due to fluid motion under a potential gradient, a composition gradient, or the effect of sinks (i.e. production wells) or sources (i.e. injection wells) as well as the effects of pressure changes on rock compressibility.

One non-linear partial differential equation is solved for each hydrocarbon component $N_i$. The distribution of each such component in the gas or liquid phases is governed by thermodynamic equilibrium, which is solved as a coupled system together with the flow equations. The numerical minimization of Gibbs' Free Energy attained by solving this system of equations represents the distribution of compositions in all phases (vapor and liquid) for that particular time step. Two so-called "equations-of-state" (EOS) are available in the invention to perform the phase equilibrium calculations. These EOS are known as Peng-Robinson and Soave-Redlich-Kwong. Both EOS formulations provide for third-parameter correction of the fluid densities via what is known in the art as "shift parameter". They also provide the flexibility to change the constant coefficients of these correlations (known in the art as "$W_A$" and "$W_B$" respectively) to better accommodate fluid characterizations that optimally match laboratory data.

Convergence within one time step is obtained by Newton-Raphson iterations using a Jacobian matrix which is derived analytically from the discretized non-linear algebraic equations. Each Newton iteration invokes an iterative linear solver which must be capable of handling any number of unknowns per cell. The time step is advanced to the next interval (typically one month or less) only after the previous step has fully converged. Then the linearization process is repeated at the next time step level.

The total number of unknowns is $2\ N_c+2$ (where $N_c$ is the total number of hydrocarbon components from fluid characterization). The first $N_c$ equations correspond to fugacity relations for thermodynamic equilibrium and, being local to each cell, can be removed from the system by Gaussian elimination since they do not involve any interaction with neighboring cells, thus reducing the burden of the iterative linear solver to only $N_c+2$ equations per cell.

Since the flow of gas in the reservoir of model M can attain high velocity near any producing wells, the present invention uses Non-Darcy flow techniques, such as rate-dependent skin at the well bore and the Forchheimer equation in the reservoir, to circumvent the linear assumption between velocity and pressure drop that is inherent to simulators based solely on Darcy's equation.

D. Computer Implementation

Figure 6:
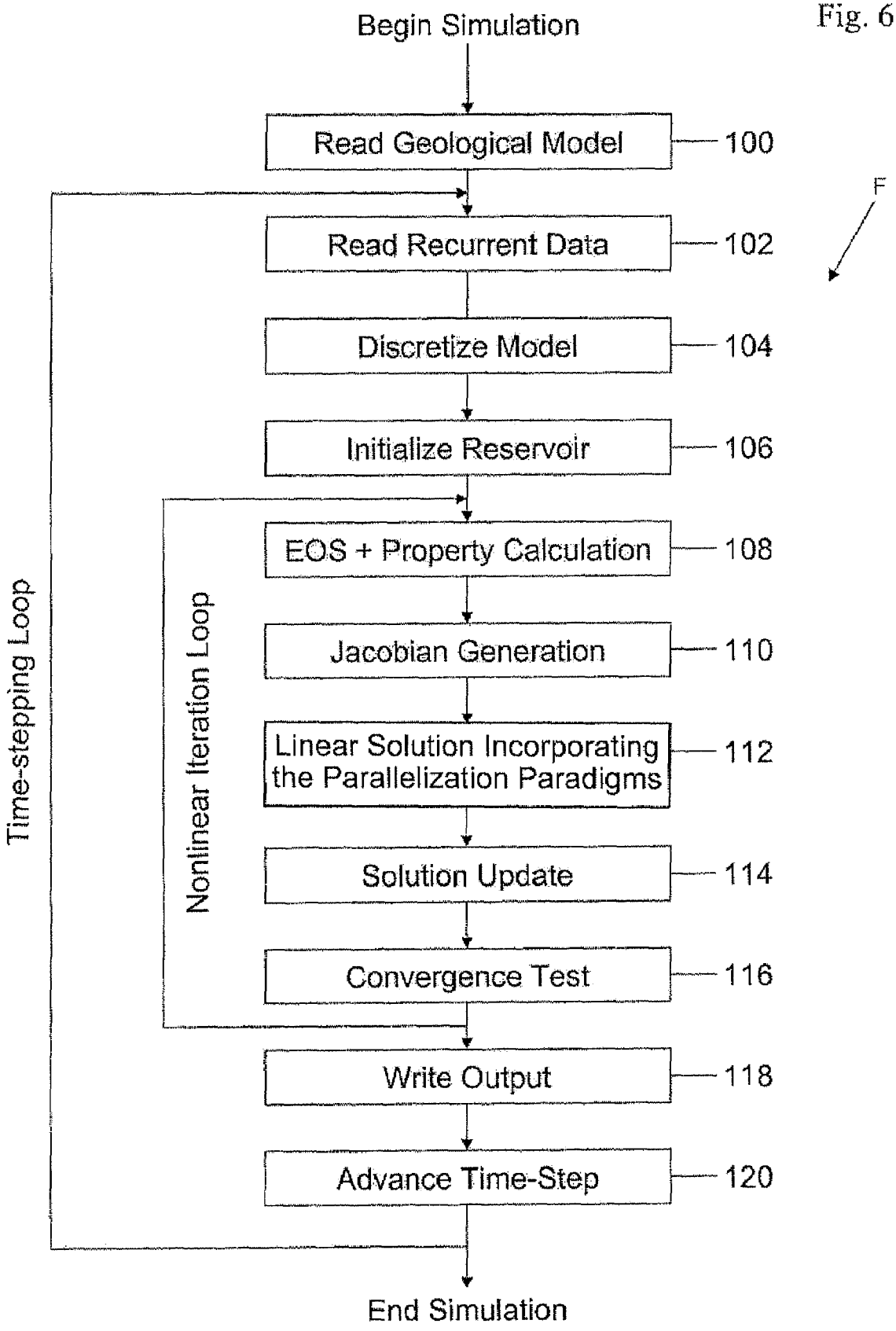
FIG. 6 is a functional block diagram of processing steps during computerized simulation of fluid flow according to the present invention in the subsurface hydrocarbon reservoir model of FIG. 1.

A flowchart F (FIG. 6) indicates the basic computer processing sequence of the present invention and the computational sequence taking place during application of a typical embodiment of the present invention.

Read Geological Model, (Step 100): Simulation according to the present invention begins by reading the geological model as input and the time-invariant data. The geological model read in during step 100 takes the form of binary data containing one value per grid cell of each reservoir model property. These properties include the following: rock permeability tensor; rock porosity, individual cell dimensions in the x, y and z directions; top depth of each cell; and x-y-z location of each existing fluid contacts (gas-oil-contact, gas-water-contact, oil-water-contact, as applicable).

Time-invariant data read in during step 100 include the fluid characterization composition and thermodynamic properties of each component (critical temperature, critical pressure, critical volume, accentric factor, molecular weight, parachor, shift parameter and binary interaction coefficients). The time-invariant data also includes fluid relative permeability tables that provide a value of relative permeability for a given fluid saturation for the reservoir rock in question.

Read Recurrent Data (Step 102): Recurrent data read in during step 102 is time-varying data and, as such, it must be read at every time step during the simulation. It includes the oil, gas and water rates of each well that have been observed during the "history" period of the simulation (the period of known field production data that is used to calibrate the simulator). It also includes production policies that are to be prescribed during the "prediction" phase (the period of field production that the simulator is expected to forecast). Production policy data include data such as rates required from each well or group of wells and constraints that should be imposed on the simulation (such as maximum gas-oil ratios, minimum bottom-hole-pressure allowed per well, etc.). This data can change over periods of time based on actual field measurements during the "history" phase, or based on desired throughput during the "prediction" phase.

Discretize Model (Step 104): Calculation of rock transmissibilities for each cell based on the linking permeability and cell geometry is performed for every cell and stored in memory. There are a number of such models for transmissibility calculation to those familiar with the art depending on the input data (such as block-face or block-center permeability). In addition, the pore volume of every cell is computed and stored in memory.

Initialize Reservoir (Step 106): Before simulation takes place, the initial distribution of the fluids in the reservoir must be computed. This process involves iteration for the pressure at every cell. The pressure at every point is equal to a "datum" pressure plus the hydrostatic head of fluid above it. Since hydrostatic head at a cell depends on the densities of the column of fluid above it, and density itself depends on pressure and fluid composition via an equation of state (or EOS, described below), the solution is iterative in nature. At each cell, the computed pressure is used to compute a new density, from which a new hydrostatic head and cell pressure is recomputed. When the pressure iterated in this fashion does not change any further, the system has equilibrated and the reservoir is said to be "initialized."

EOS and property calculation (Step 108): Fluid behavior is assumed to follow an equation-of-state (EOS). The EOS typically chosen in the art should be accurate for both liquid and vapor phase, since its main purpose is to provide densities and fugacity coefficients for both phases during phase equilibrium calculations. The present invention provides the choices of using either Peng-Robinson or Soave-Redlich-Kwong, two popular equations-of-state known to those familiar with the art. The general (or "canonical") form of the equation of state is:

$$P = \frac{RT}{V - b_1} - \frac{a_m}{(V + B_2)(V + b_3)}$$

where the parameters and variables in the foregoing equation are defined in the manner set forth above.

For calculations using the Peng-Robinson equation of state, the b parameters are defined as:

$$b_1 = b_m;\ b_2 = (1+\sqrt{2})b_m;\ b_3 = (1-\sqrt{2})b_m$$

For calculations using the Soave-Redlich-Kwong equation of state, the b parameters are defined as:

$$b_1 = b_m;\ b_2 = b_m;\ b_3 = 0$$

Furthermore, the following so-called "mixing rules" to generate EOS parameters from multi-component mixtures used are the conventional ones known in the art:

$$a_m = \left(\sum x_i \sqrt{a_i}\right)^2 - 2\sum_{j>i} x_i \sqrt{a_i}\, x_j \sqrt{a_j}\, \delta_{ij}$$

$$b_m = \sum x_i b_i$$

-continued $$A_i = 2\sqrt{a_i}\left(\sum x_i \sqrt{a_i} - \sum_{j \neq i} x_j \sqrt{a_j \delta_{ij}}\right)$$

where the $x_i$ are the individual mole fractions of each component "i" in each phase. And the individual values of each component's a and b parameters are given by:

$$a_i = W_A \frac{(RT_{ci})^2}{P_{ci}}\left[1 + W_F\left(1 - \sqrt{T_{ri}}\right)\right]^2$$

$$b_i = W_B \frac{RT_{ci}}{P_{ci}}$$

For Peng-Robinson:

$W_B = 0.0778;\ W_A = 0.45724$ $W_F = 0.37464 + 1.54226\omega - 0.26992\omega^2$ For Soave-Redlich-Kwong:

$W_B = 0.0866;\ W_A = 0.4275$ $W_F = 0.48 + 1.574\omega - 0.176\omega^2$

The $W_A$ and $W_B$ parameters are usually kept constant in EOS calculations described in the literature, but the techniques of the present invention allow them to be specified as inputs in the present invention. This occurs because, in some cases, a more accurate fluid characterization can be achieved by changing these parameters.

In order to compute the equilibrium compositions (in both liquid and vapor phase, should both phases exist), a system of nonlinear equations must be solved, which enforce the thermodynamic constraint that, for each component c of a total of $N_c$ hydrocarbon components the product of the fugacity coefficient times mole fraction must be identical in both phases. This is thermodynamically equivalent to the equality of fugacities for both phases. In mathematical notation:

$$F \equiv \ln(\phi_i^G y_i) - \ln(\phi_i^L x_i) = 0$$

It is to be noted that there is one such equation for each hydrocarbon component, so this represents a system of $N_c$ nonlinear equations. In the system of nonlinear equations the natural logarithm is typically used in the art because the fugacity coefficients are usually given in logarithmic form. In order to compute the fugacity coefficient needed in this equation, the EOS must be integrated in accordance to the thermodynamic relationship:

$$\ln\phi = \int_0^P \left(\frac{V}{RT} - \frac{1}{P}\right) dP$$

where the parameters and variables are defined in the manner set forth above.

Integration results in the analytical expression:

$$\ln\phi_i = \frac{b_i}{b_m}(Z - 1) - \ln(Z - b_m) + \frac{1}{\gamma b_m}\left(\frac{a_m b_i}{b_m} - A_i\right)\ln\frac{Z + \alpha b_m}{Z + \beta b_m}$$

For which, using Peng-Robinson:

$\alpha=1+\sqrt{2};\ \beta=1-\sqrt{2};\ \gamma=2\sqrt{2}$

Or, using Soave-Redlich-Kwong:

$\alpha=1;\ \beta=0;\ \gamma=1$

The present invention solves this system of equations coupled with the species balance equations, which are discussed below, to provide simulation of fluid composition of the reservoir being modeled.

The molar density of each phase (or rather its reciprocal, the molar volume) is solved from the cubic EOS. Unfortunately, the volume produced by such two-parameter (a-and-b) equations of state like Peng-Robinson and Soave-Redlich Kwong tends to overestimate the gas volume and underestimate the liquid volume in many situations. This, however, may be corrected by a third parameter (c), which is known in the art as a "shift parameter":

$$V=V_{EOS}-c$$

or $$V=V_{EOS}-\Sigma s_i b_i x_i$$

where $s_i$ is the individual shift parameter per component i.

Jacobian generation (Step 110): In addition to the $N_c$ equations for phase equilibrium described above, one species balance equation for each component, plus water, must be solved (i.e. a total of $N_c$+1 species equations) by computer processing. The species balance equation takes two forms in the present invention: the more common Darcy form, which assumes that the pressure drop relates linearly to flow velocity, and a Forchheimer form, which adds a quadratic velocity term which is of importance for higher velocity flows, particularly for gas reservoirs. For this discussion, the simpler Darcy form is used:

$$\frac{\partial N_i}{\partial t}=\nabla\sum_{j=1}^{P}\rho_j\frac{Kk_{rj}}{\mu_j}\xi_{ij}(\nabla P-\gamma_j\nabla z)+q_i$$

where the parameters and variables are defined in the manner set forth above.

The equilibrium composition equations and the species balance equations are discretized by upwind finite-differences and linearized to create a Jacobian sub-block matrix containing $2N_c$+2 rows and $2N_c$+2 columns in each sub-block matrix. The first $N_c$ rows of each sub-block come from the phase equilibrium (i.e. equality of fugacities described earlier). The next $N_c$ rows are populated with the species balance and the last two rows correspond to a water balance equation and a total volume balance (to guarantee that the saturations of all phases add up to 1).

A suitable form of water balance equation for use in modeling according to the present invention, and using parameters and variables as defined above, is as follows:

$$\frac{\partial N_w}{\partial t}=\nabla\cdot\rho_w\frac{Kk_w}{\mu_w}(\nabla P-\gamma_w\nabla z)+q_w$$

The system of 2 $N_c$+2 equations described above is thus a vector equation of the form:

$$J\delta x=-F$$

Where F is the vector of residuals of the nonlinear equations, J=dF/dx is the Jacobian matrix and δx is the vector of "changes" to the solution vector x generated by the previous nonlinear iteration.

Linear Solution (Step 112): The system of equations given above is a very large, but sparse, matrix of sub-blocks consisting of seven diagonals. For example, given a one-million-cell and 12-component reservoir simulation, the linear system to be solved takes the form of one-million rows with seven sub-block entries per row. Each sub-block is itself a 26×26 matrix. In the present invention, the first $N_c$ equations are removed from the linear system by direct Gaussian elimination. This is possible because the fugacity equilibrium equations only have one sub-block matrix in the main diagonal and can therefore be eliminated recursively, reducing the number of unknowns to $N_c$+2 (down from 2 $N_c$+2).

Even after this reduction, the remaining system in this example is still very large (14 million unknowns). The only way to practically tackle systems of this size in the art is by using an iterative linear solver, which is almost invariably based on the convergence acceleration provided by conjugate-gradients. A parallel iterative linear solver is utilized, incorporating the parallelization paradigms, which are discussed below. The solver uses a preconditioner based on multiple terms of a truncated series expansion (i.e. an approximate inverse to the original matrix). Acceleration is provided by the Orthomin(k) conjugate-gradient accelerator, which is widely known and utilized in the art. Using an IBM Nighthawk II supercomputer (32 cpu's laid out as 16 OpenMP threads and 2 MPI processes) a typical in-house solver time for this problem size is 0.33 microseconds per linear iteration per unknown, thus solving linear systems with millions of unknowns in just a few seconds.

Solution Update (Step 114): The solution vector δx obtained from solving the system of linear equations is added to the current solution vector (x) and this represents the updated solution vector in the nonlinear iteration loop. Although this is, for the most part, what is known in the art as "Newton iteration", some checks to damp the solution vector take place in the present invention in order to improve the numerical stability of the simulation. As a result, the full "Newton step" is not always taken. More specifically, the maximum change in pressure and moles are controlled, so that the solution does not drift into conditions that may drastically change the phase in individual cells which potentially can adversely affect convergence. The present invention has incorporated a user-controlled parameter for these quantities. For example, experience shows that a pressure change limit of a maximum of 100 psi per nonlinear iteration greatly contributes to reduce the number of time step cuts discussed in the next paragraphs during simulation.

Convergence Test (Step 116): The individual residuals of the linear equations resulting from step 114 are checked against user-prescribed tolerances. If these tolerances are satisfied, the nonlinear iteration loop is exited, solution output is written to file during step 118 for the current time step and the time step is advanced during step 120 to the next level.

If these tolerances are not satisfied, processing according to the nonlinear iteration loop returns to step 108 and continues. But if the number of nonlinear iterations becomes excessive (typically more than 6, but otherwise a user-prescribed parameter), a decision is made to cut the time step size (by usually 50%) and repeat the entire nonlinear iteration loop again beginning at step 108 for the same time level. An excessive number of iterations is an indication that the solution has diverged and the reservoir changes may be too large to be adequately modeled with the time step previously chosen. A time-step cut is expected to not only reduce the magnitude of these changes but to also increase the diagonal dominance of the Jacobian matrix, which always has a beneficial effect on the convergence of the linear solver.

Write Output (Step 118): Pressures, saturations, mole fractions and other compositional variables (in the form of three-dimensional grids) are written out in binary format as Disk I/O at the end of each time step. Also well information regarding rates, pressures and the state of layer perforations (open or closed) is written out.

Figure 3:
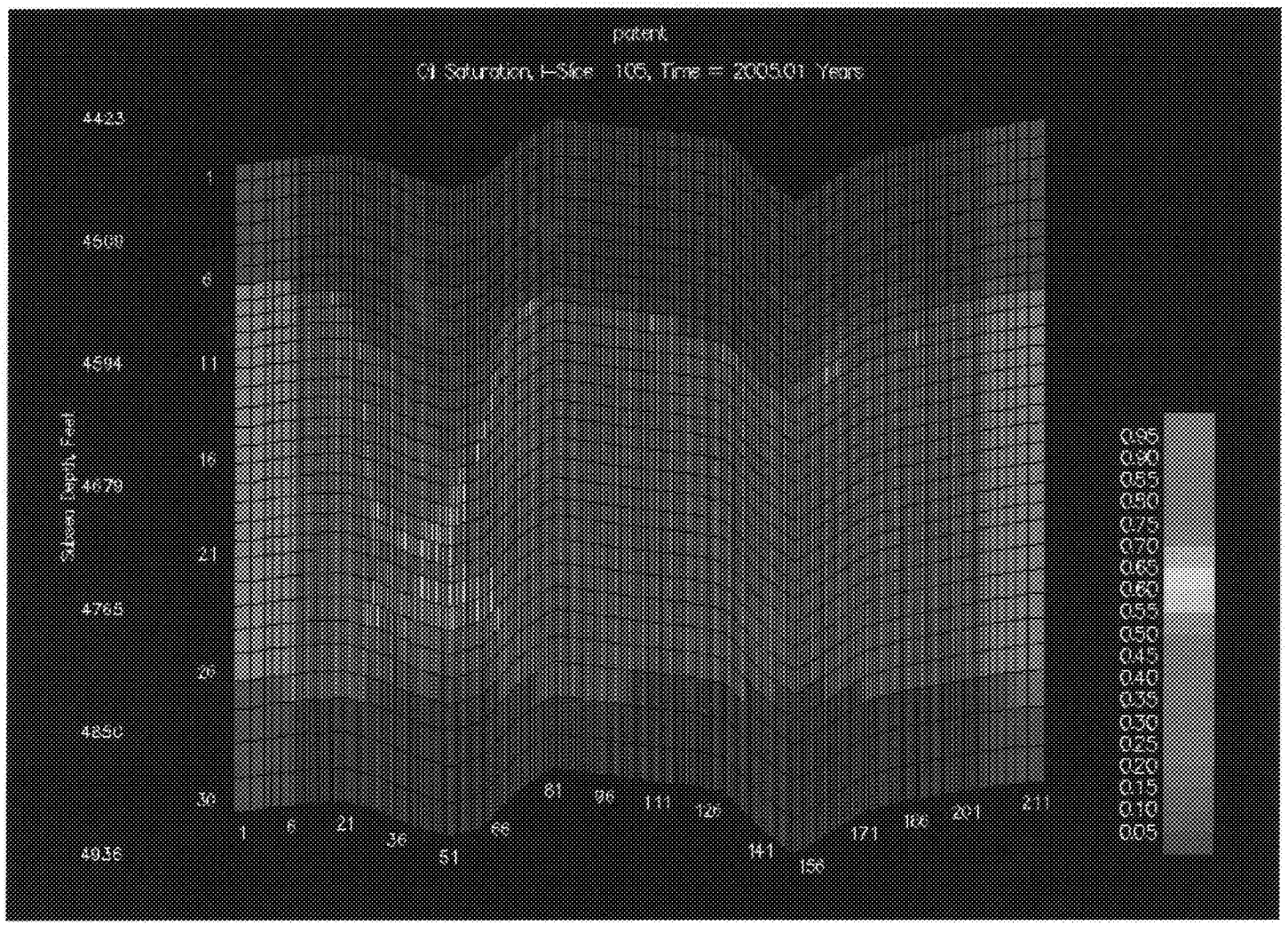
FIG. 3 is an example data plot according to the present invention, of a section of the model along the line 3-3 of FIG. 1C, showing computed oil saturation as a function of depth at a future date for that location in the subsurface hydrocarbon reservoir model of FIGS. 1A, 1B and 1C.
Figure 4:
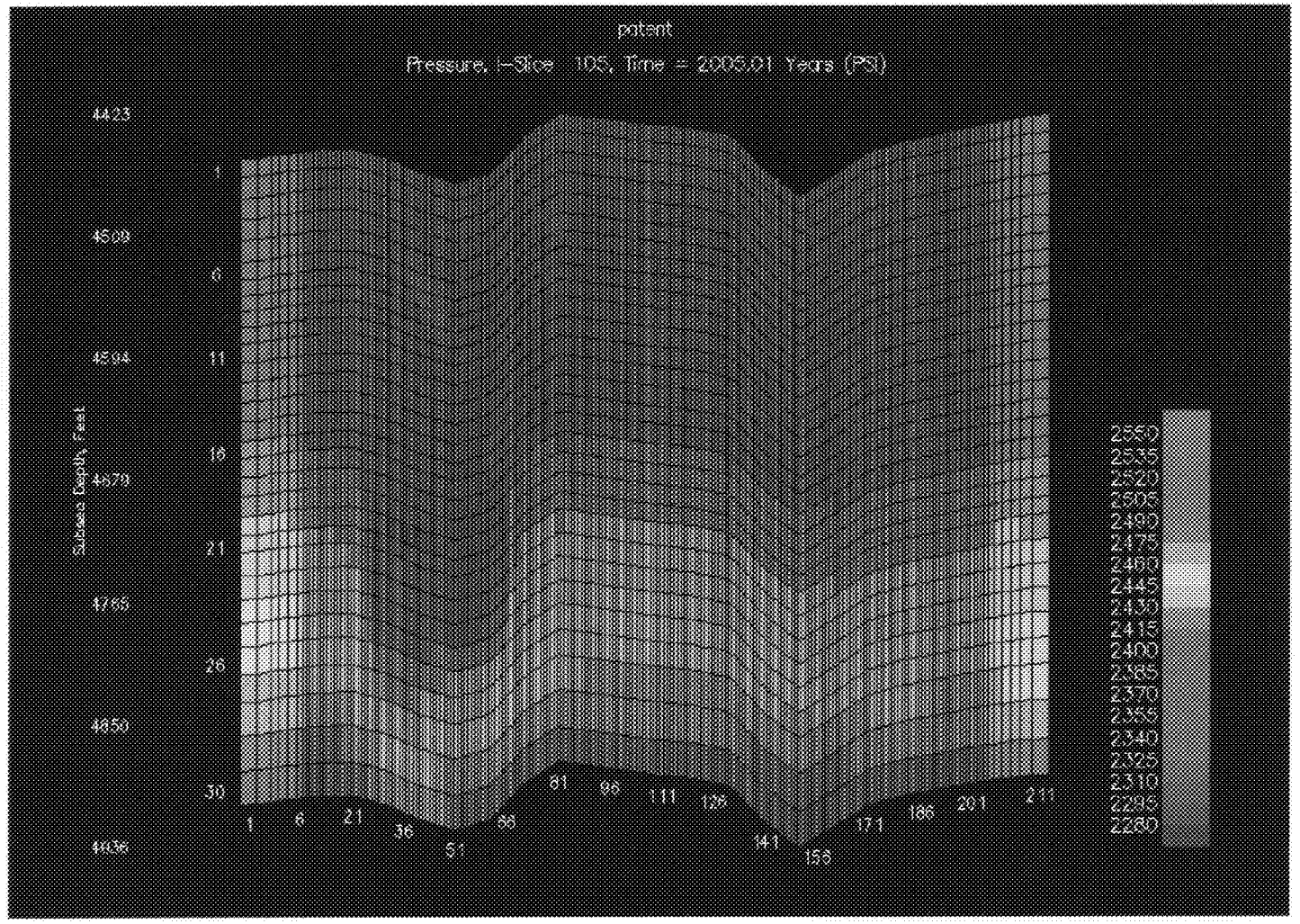
FIG. 4 is an example data plot according to the present invention, of a section of the model along the line 3-3 of FIG. 1C, showing computed fluid pressure as a function of depth at a comparable date to the date of the display in FIG. 3 for that location in the subsurface hydrocarbon reservoir model of FIGS. 1A, 1B and 1C.

Disk I/O is performed in a serial fashion in the sense that the information contained in each MPI process is broadcast to the master process, which is in charge of writing the output to disk files. Once the model has been completed for a time of interest, data relating to that model may be presented in output displays. FIG. 3 is an example display of oil saturation along a line indicated at 3-3 of FIG. 1C in the model M at a particular time of interest for a "prediction" phase. FIG. 4 is a plot of fluid pressure, showing the fluid pressure profile for cells along the same line and as FIG. 3 and the same time of interest.

Figure 5A:
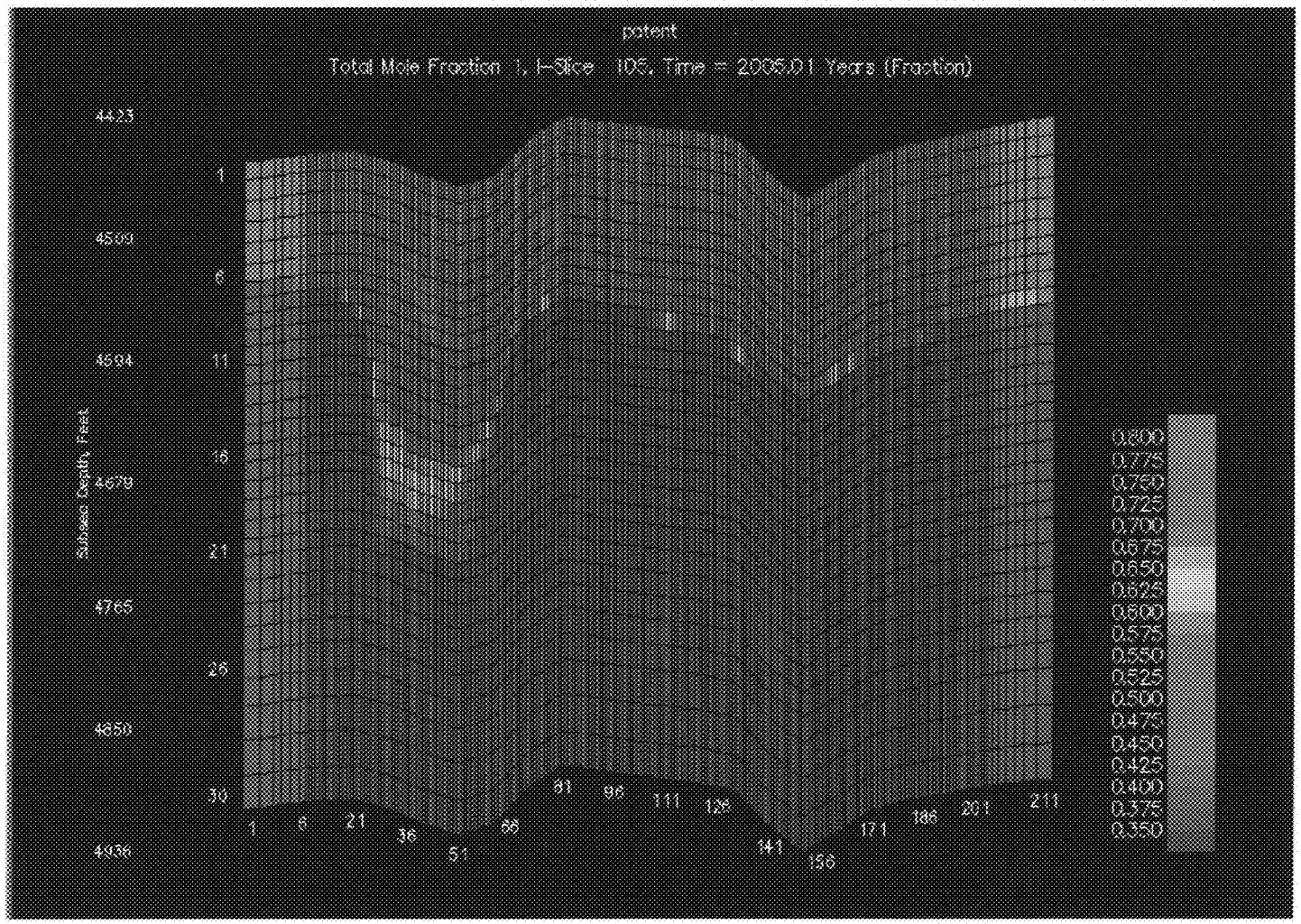
FIGS. 5A, 5B, 5C and 5D are example data plots according to the present invention, of a section of the model along the line 3-3 of FIG. 1C, showing computed mole fraction for different components of a compositional fluid as a function of depth at a comparable date to the date of the display in FIG. 3 for that location in the subsurface hydrocarbon reservoir model of FIGS. 1A, 1B and 1C.
Figure 5B:
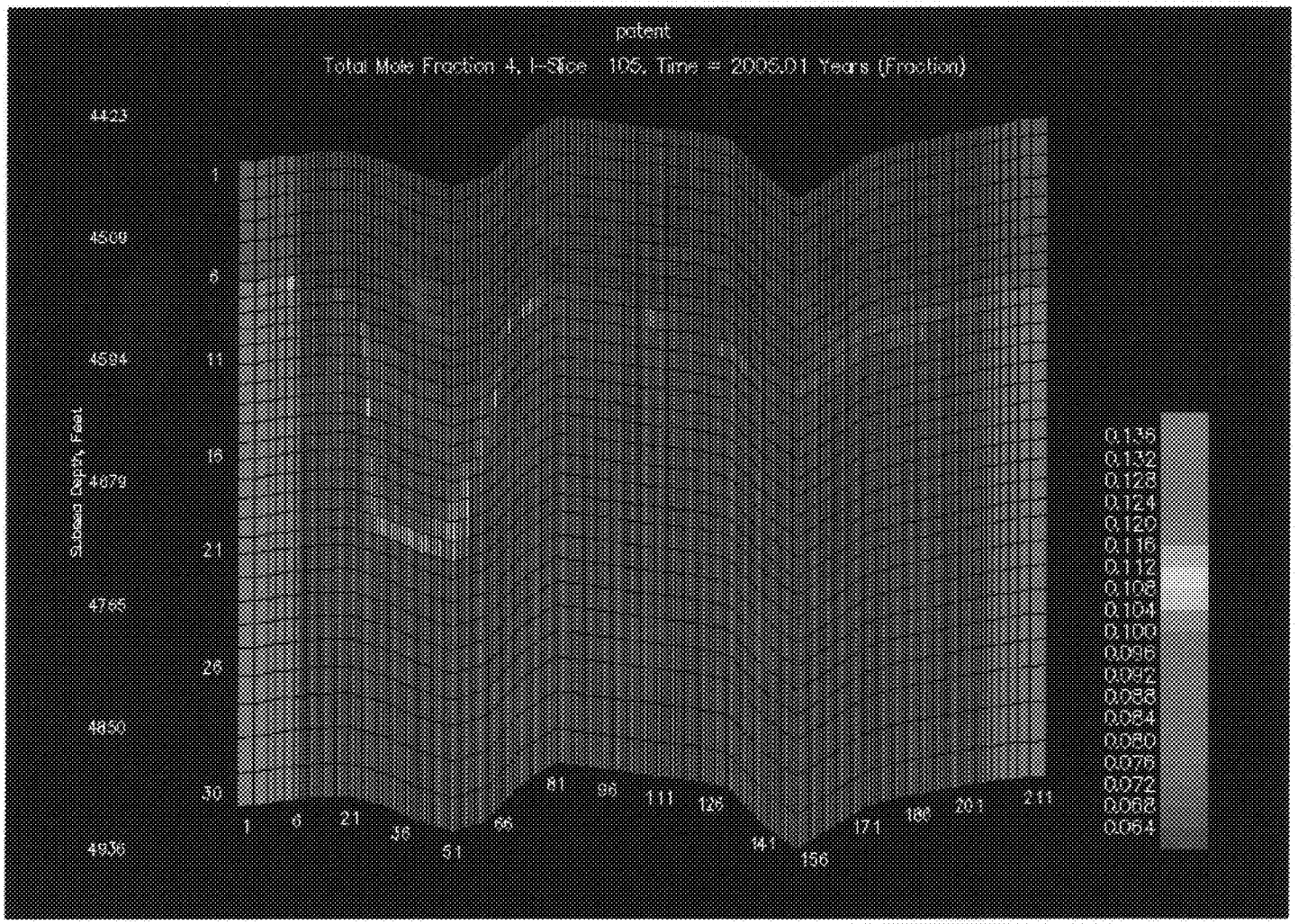
Figure 5C:
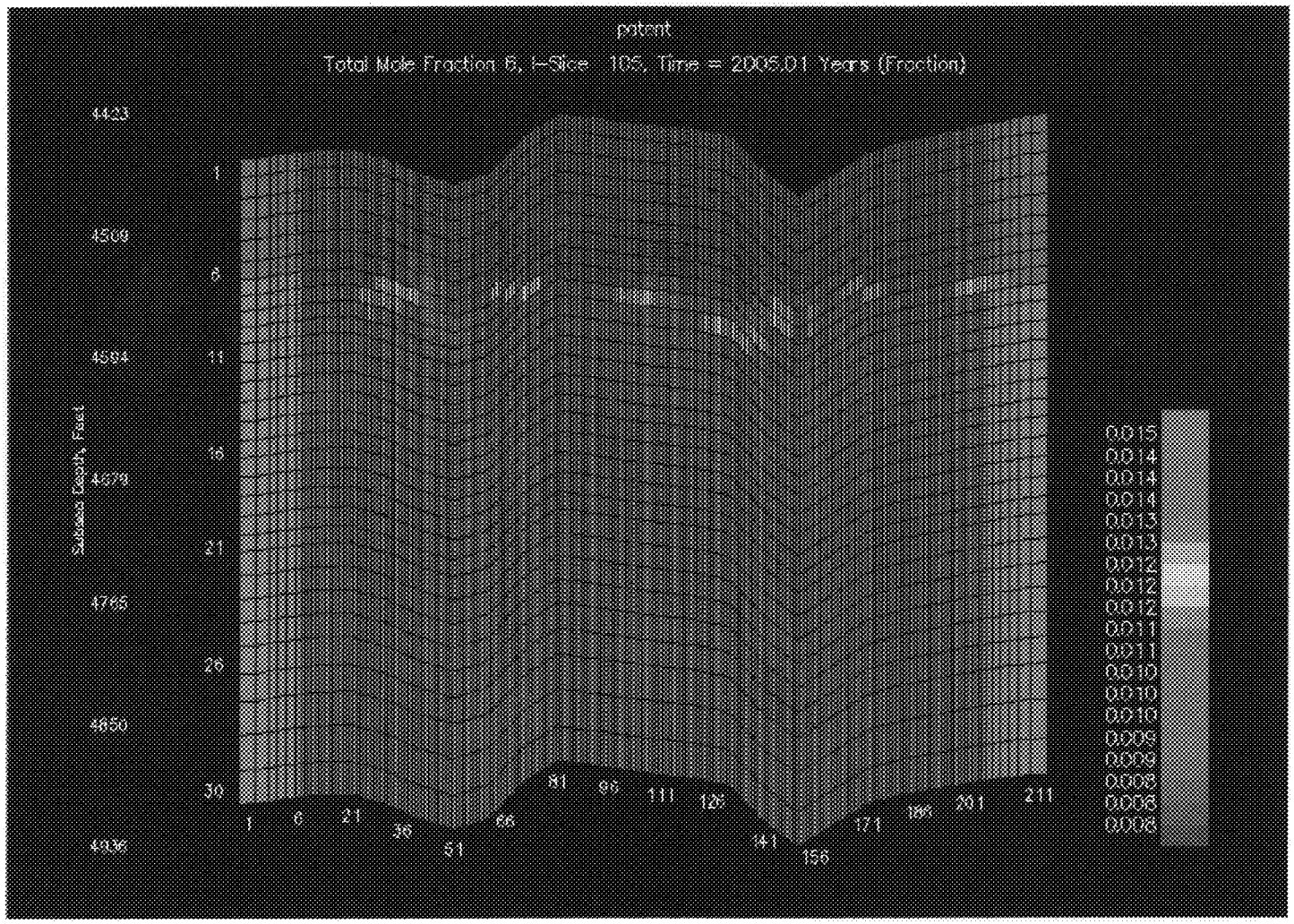
Figure 5D:
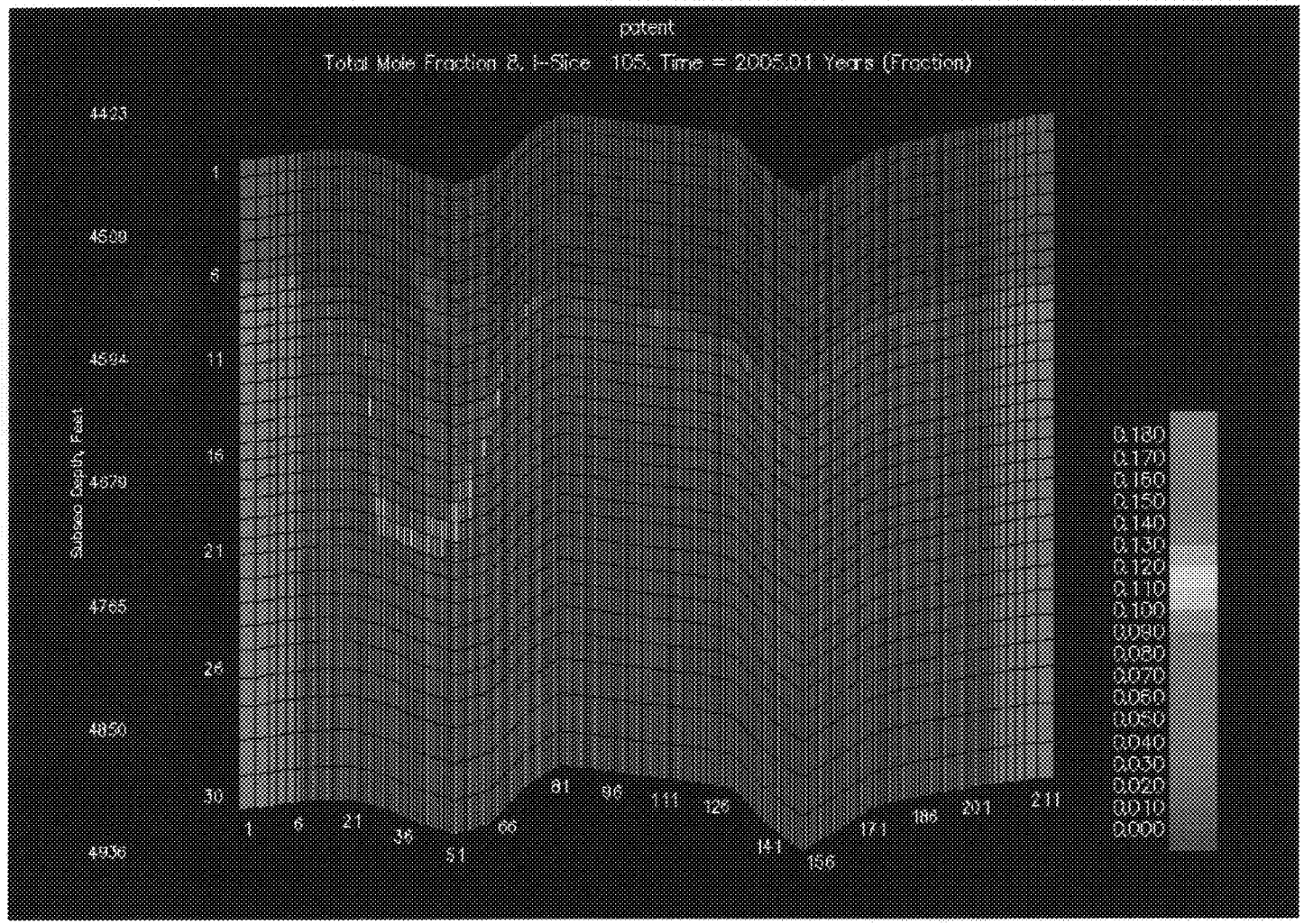

FIGS. 5A, 5B, 5C and 5D are plots of computed mole fractions for four components of compositional fluid present in the cells along the same line for the same time of interest as the data displays of FIGS. 3 and 4. FIG. 5A is a plot or mole fraction profile for component 1, methane, the highest component in the compositional fluid. FIG. 5B is a mole fraction profile for component 4 which is butane, also known as the C4 fraction. FIG. 5C is a mole fraction profile for component 6 or octane, which is also referred to as the C8 fraction. FIG. 5D is a mole fraction profile for component 8 or dodecane, which is also known as the C12 fraction.

The displays of FIGS. 3, 4, 5A, 5B, 5C and 5D are of a single line or profile, along the line 3-3 of FIG. 1C from the model M. As can be seen from FIG. 3, there are some 30 cells in the depth or z dimension, while there are over two hundred cells in the lateral or y dimension along the line 3-3 of FIG. 1C. Thus FIGS. 3, 4, 5A, 5B, 5C and 5D are displays of data values obtained from the present invention for about six thousand cells of the more than one million cells in the model, and only at one particular time of interest. The displays indicate, however, the types of data available in detail for selected locations at a time of interest in a giant reservoir once the model M for the subsurface reservoir has been simulated with the present invention.

Any number of displays along either the x or y dimensions for the cells along particular lines of interest in those dimensions can be formed for one or more specified dates or times from the model M once simulated with the present invention. The present invention, in its computer platform implementation with parallelization, forms the model M with high efficiency and scalability. The particular displays are presented by way of example and to indicate that the adverse coarsening effects of the prior art resulting from upscaling are avoided. Also, the mole fractions of the various component fluids are clearly identified and made distinguishable.

Displays may thus be formed of results obtained for the model M at any desired number of computed times and locations in the model M. The output of the processing results is essential for both post-mortem analysis of results at the end of simulation and for online/real-time visualization of the simulation on a computer workstation. A reservoir engineer then may use the output to make field development decisions, study multiple field production scenarios, decide how to improve reservoir models and determine what issues remain for further study.

Figure 11:
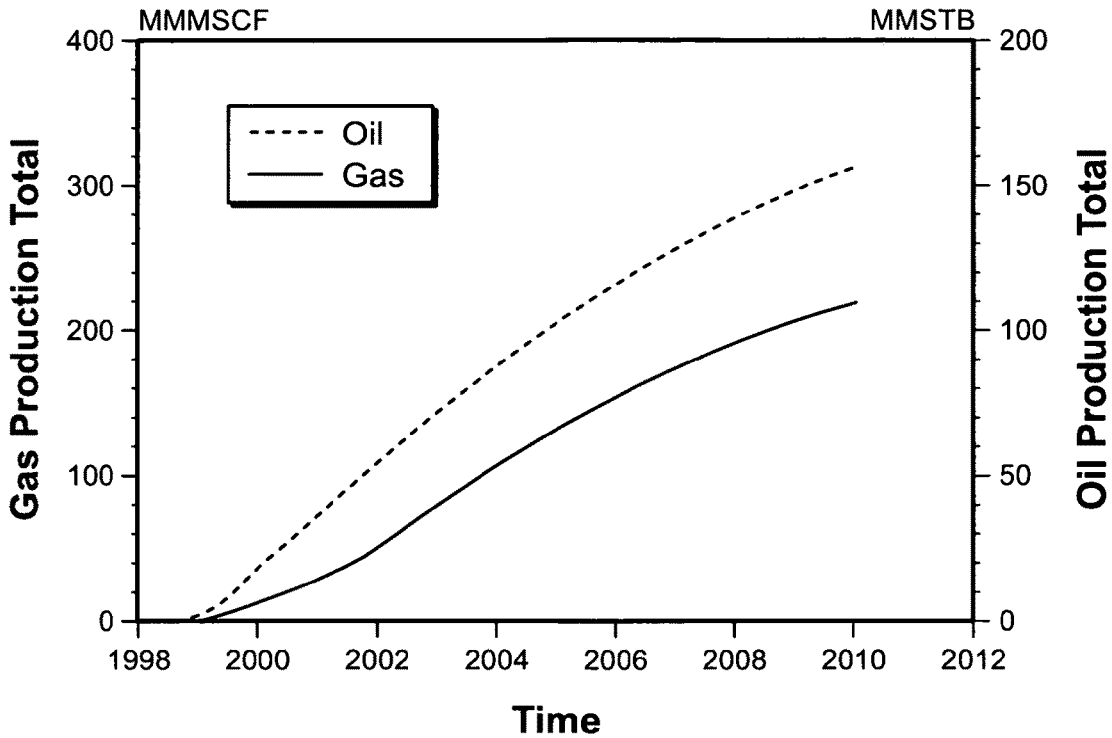
FIG. 11 is a plot of projected gas production and projected oil production over a number of future years obtained according to the present invention from the model of FIGS. 1A, 1B and 1C.

Advance Time-Step (Step 120): Upon complete satisfaction of the solution at the previous time level, the time step is advanced and processing returns to Step 102 for the next time of interest. The time-stepping policy implemented has been to tentatively select the new time step as 1.5 times the size of the previous time step, subject to a maximum time step size prescribed by the user (typically 30 days). At the very beginning of a simulation, initial time step is typically set to 1 day. If a transition from history-mode to prediction-mode is crossed during the simulation, the time step size is also reset to 1 day. If every time step taken is successful (i.e. solution converges within the prescribed limit of nonlinear iterations), a typical sequence of time steps from the beginning of a simulation is, in days, (1, 1.5, 2.25, 3.375, 5.0625, 7.59375). After this point, the time step is typically set to the number of days remaining to arrive to end-of-the-month (for writing output) and not to the corresponding 11.39 days that would have been chosen. After the first month is completed, the step will be set to 15 or 15.5 days (instead of 17.0859) to allow a smooth stepping to the next end-of-the-month, etc. Processing continues until data has been obtained for the reservoir over the range of dates or times of interest, at which time simulation operations may be concluded. FIG. 11 is an example projection of oil production and gas production for future years obtained according to the present invention for the model M.

E. Computer Platforms and Parallelization

Figure 8:
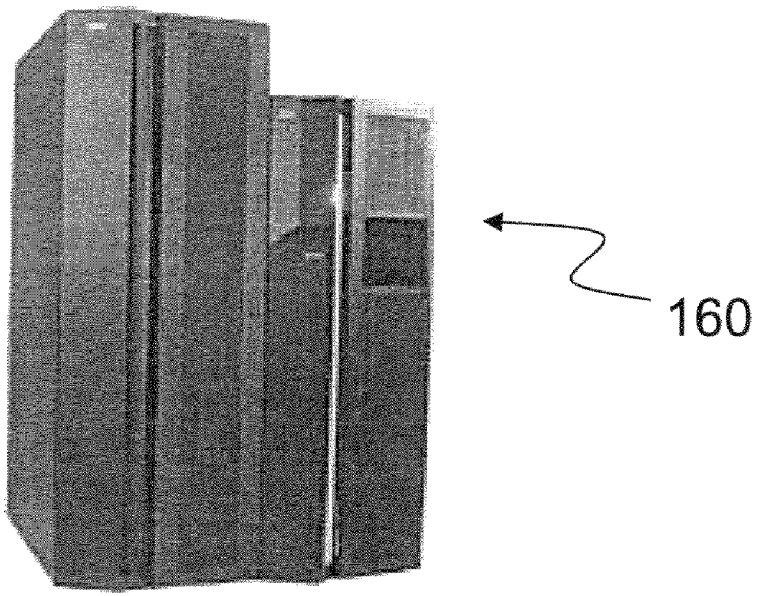
FIGS. 7, 8, 9 and 10 are schematic diagrams of various computer architectures for implementation of mixed-paradigm parallel processing of data for flow measurement simulation according to the present invention.
Figure 7:
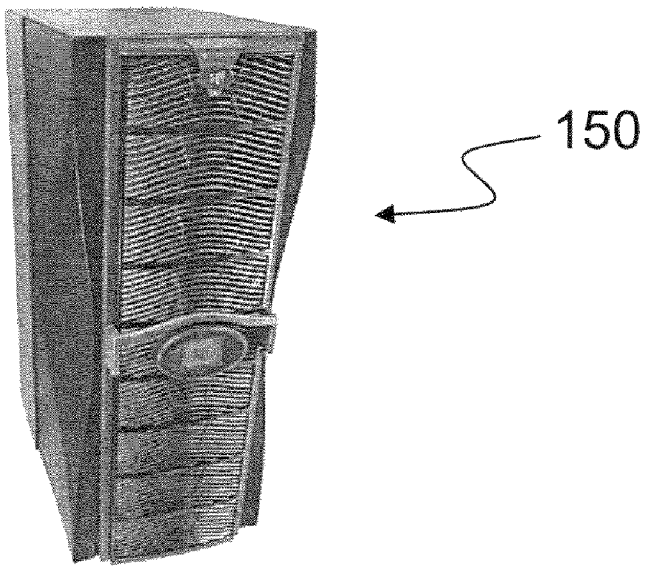
Figure 9:
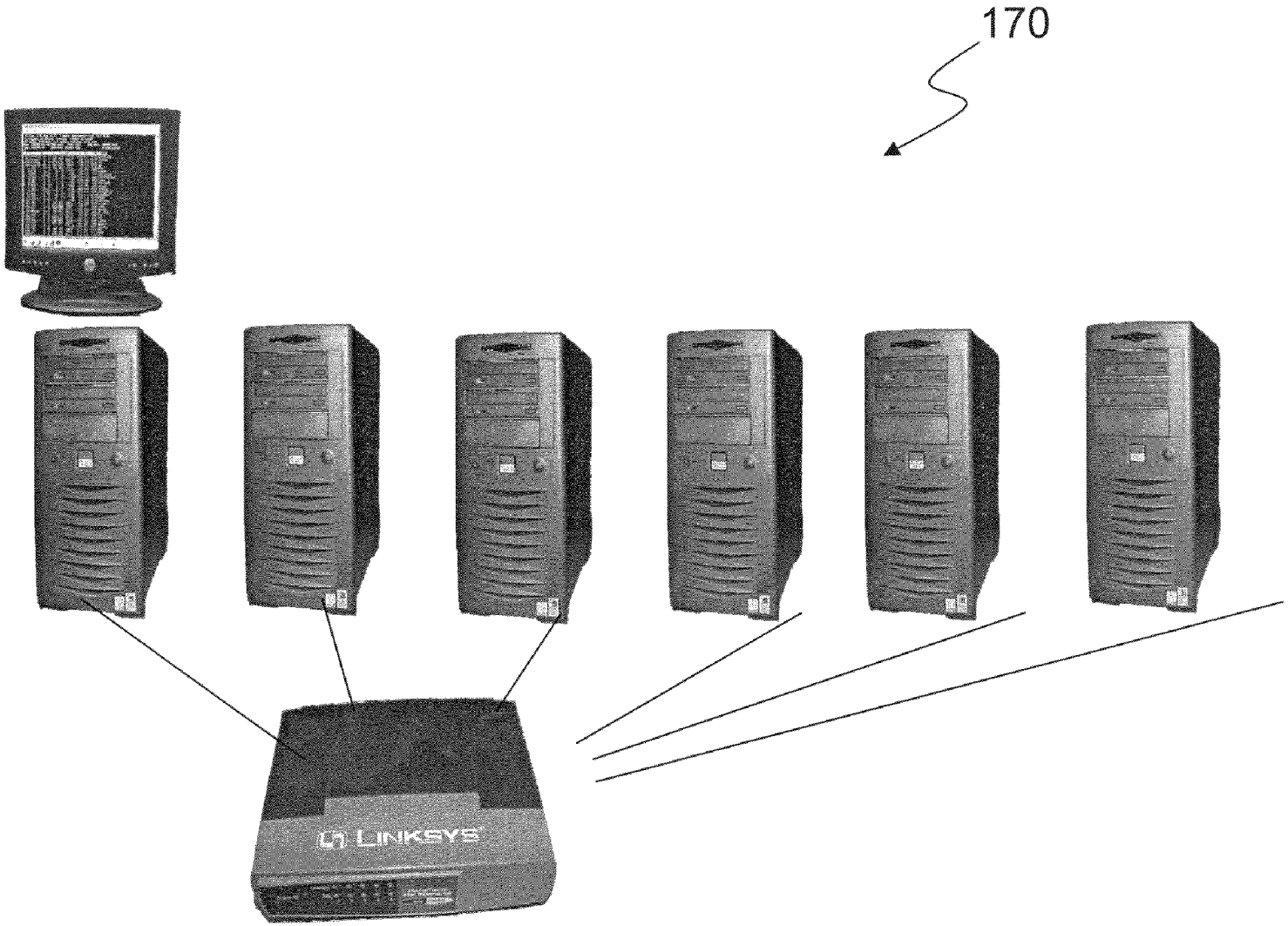
Figure 10:
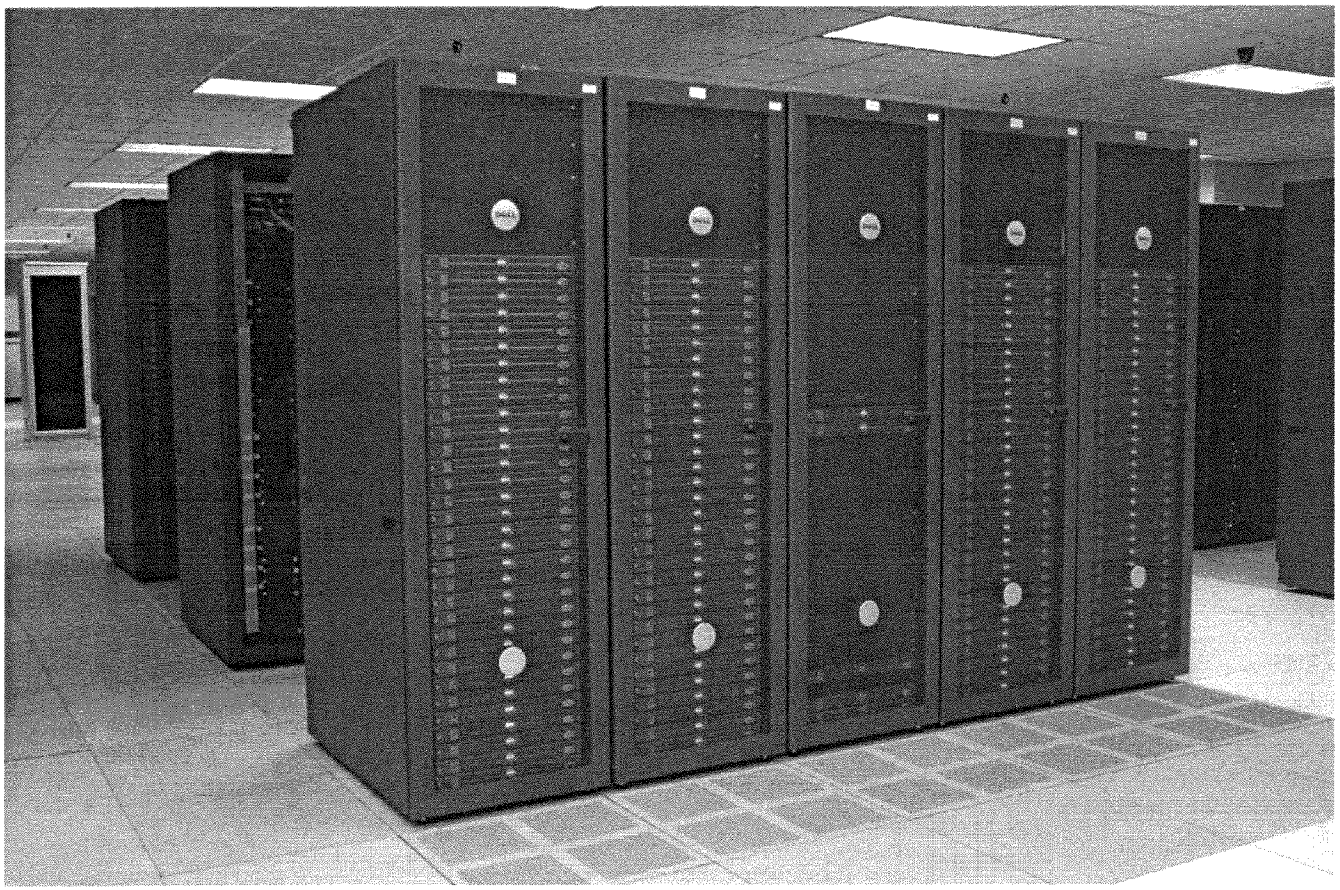

A significant contribution of the present invention is its mixed-paradigm parallelization, or ability to work in a variety of computer platforms while achieving maximum efficiency and scalability. Systems that have been tested for use on the present invention include:

- Shared-memory supercomputers such as shown at 150 (FIG. 7) (e.g. an SGI 3800 from Silicon Graphics, Inc.);
- Distributed-memory supercomputers as shown at 160 (FIG. 8) (e.g. IBM Nighthawk II and IBM p690);
- Self-made personal computers (PC) clusters as shown at 170 (FIG. 9) (clusters created by direct interconnection of individual PC's via a fast-Ethernet hub); and
- A production PC cluster as shown at 180 (FIG. 10).

These various systems range widely in cost, and the platform selected may vary from user to user.

To achieve high efficiency and scalability, the present invention implements OpenMP parallelization along the y-axis of the reservoir (north-south axis) and MPI parallelization along the x-axis of the reservoir (east-west axis). OpenMP is a parallelization paradigm for shared-memory computers while MPI is a parallelization paradigm for distributed-memory computers.

In OpenMP, individual parallel "threads" access the data in other threads by fetching the appropriate information from shared memory banks. In MPI the individual parallel "processes" access data from other processes via explicit hardware communication calls (send/receive) that are synchronized at each end.

Complete reservoir and production data have been used according to the present invention for one gas-condensate giant Middle East reservoir, and one oil reservoir with gas cap. Reservoir data included the geological, seismic and flow-test calibrated reservoir information, integrated with detailed geological models. Reservoir data also included historical production/injection data per well, well completion data, fluid data including critical pressure, volume and temperature data, necessary to calculate fluid densities, viscosities and other relevant thermodynamic data from the simulator's Peng-Robinson equation-of-state.

The simulator results obtained with the present invention were compared for accuracy with other simulators using small benchmark problems. A 15-year simulation for an 8-component, 1.2-million-cell gas-condensate reservoir was carried out in under 6 hours using a 32-processor IBM p690 parallel computer. On the same problem an IBM Nighthawk II parallel computer attained a parallel efficiency of 99% when increasing the number of processors from 32 to 64 (i.e. a speedup of 1.99 out of a maximum possible of 2.0 was obtained).

The present invention was also tested on smaller compositional models running on a self-made PC cluster consisting of 6 PC'S using a fast-Ethernet connection between nodes. An 8-component, 129,000-cell model was solved in 7.4 hours; attaining an efficiency of 94% when increasing the number of nodes from 3 to 6 (i.e. a speedup of 1.88 out of a maximum possible of 2 was observed).

No matter what memory architecture of the computer system is selected (either shared or distributed memory), the present invention allows users to parallelize efficiently for maximum throughput. The scenarios can be considered as follows:

a) Shared-memory machines: in a system like the SGI 3800 super-computer, any number of cpu's (up to 1024) can be utilized as either OpenMP threads or MPI processes or a combination of both. If T is the number of OpenMP threads, P the number of MPI processes and N the total number of cpu's available for the job, then N=P*T. For example, if N=32 cpu's and 2 MPI processes are used, then T=16 threads are involved. These systems provide maximum flexibility in that one can use a variety of P and T combinations (P,T) for each choice of N. For example, with N=32 the combinations (1,32), (2,16), (4,8), (8,4), (16,2) and (32,1) are all possible. Experience dictates, however, that these systems benefit from their communication-free shared memory environment, so one would likely chose T=32 and P=1 in this case. But as the latency of memory access tends to increase beyond 32 threads, it has been found optimal in this instance to use T=32 and P=N/T for systems with more than 32 processors. In this case, for N=256 CPU's, 8 processes and 32 threads would be recommended, but one can use any combination and the present invention still produces correct results. However, computer time is likely to be increased.

b) Distributed-memory machines: These systems typically include some local shared memory between small numbers of cpu's. The IBM Nighthawk II systems consist of 16 shared-memory cpu's per "node". In this case, one maximizes the advantages of shared-memory (to avoid inter-process communication) by setting T=16 and P=N/T (P will coincide with the number of "nodes" in this case). The newer IBM p690 "Regatta" systems consist of 32 shared-memory cpu's per "node". Again, to maximize the advantages of shared-memory one sets T=32 and P=N/T. By laying out the parallelization in this optimal fashion, near-100% efficient scalability has been observed for the present invention (a 1.2-million cell/8-component problem attained 99% parallel efficiency on an IBM Nighthawk II).

c) Self-made PC-clusters: Self-made PC-clusters are typically made by interconnecting single-cpu PC's. Therefore, no shared-memory advantages are realized and the simulations are carried out with as many MPI processes as cpu's (i.e. T=1, P=N). The speed of these cpu's has increased dramatically over the last 10 years, so they can offset the disadvantage of slow inter-process communication (usually fast-Ethernet) by the sheer speed of the processor. An added advantage of the computations tackled by the present invention is that, due to the multi-component (many variables) nature of the problem, the ratio of computation-to-communication is typically very high and masks quite well any slow interconnect. For example on a self-made cluster, a 94% efficiency was retained when doubling the number of PC's from 3 to 6 in the solution of a 129,000-cell model with 8 components.

Recently, commercial PC-clusters with very fast interconnects (Myrinet and Quadrix) have become available and claim to increase interconnect speeds by factors of 10 or more over fast-Ethernet. A few commercial clusters are offering 2, 4 or 8 shared-memory cpu's per node. On these, it will be possible to experiment with OpenMP as the memory bandwidth in these commodity processors increases over time. Therefore, the present invention is already designed to take advantage of such a possible computer hardware.

The distribution of work between threads and/or processes is arranged by linear mapping of the problem dimensions. For example, a reservoir model with NX=200 and NY=128, using 4 processes and 16 threads would subdivide the Y-axis into 8 grid-blocks per thread and the X-axis into 50 grid-blocks per process. The distributed-memory communication only happens at the edges of each "chunk" of blocks in the process (i.e. between X locations=50-51, 100-101 and 150-151). There are zero-flow boundaries at all edges of the reservoir, i.e. there are no periodic boundary conditions requiring communication between the left-end of MPI process 1 and the right-end of MPI process 4.

So far as is known the present invention is the only mixed paradigm reservoir simulator in the industry using a hybrid combination of OpenMP and MPI parallelizations. MPI has been so far the preferred parallelization paradigm in most scientific/technical parallel computing but few real world applications have successfully combined it with OpenMP.

From the foregoing, it can be seen that the present invention is a fully-parallelized, highly-efficient compositional implicit reservoir simulator capable of solving giant reservoir models frequently encountered in the Middle East and elsewhere in the world with fast turnaround time in a variety of computer platforms ranging from shared-memory and distributed-memory supercomputers to commercial and self-made clusters of personal computers. Unique performance capabilities offered with the present invention enable analysis of reservoir models in full detail, not only in fine geological characterization but also in high-definition of the hydrocarbon components present in the reservoir fluids.

The present invention thus permits persons interested to simulate historical performance and to forecast future production of giant oil and gas reservoirs in the Middle East and the world, especially in cases where compositional effects are important. The present invention allows reservoir simulation with resolution in geological detail and fluid characterization, while providing fast turnaround through platform-independent high-performance parallel computing techniques and algorithms. The present invention provides as output the component mass and volumetric quantities forecast over a period of time for a given reservoir model. These quantities are essential for reservoir management decision-making and to provide information for other engineering design systems, such as design of surface facilities and downstream processing.

The invention has been sufficiently described so that a person with average knowledge in the matter may reproduce and obtain the results mentioned in the invention herein Nonetheless, any skilled person in the field of technique, subject of the invention herein, may carry out modifications not described in the request herein, to apply these modifications to a determined structure, or in the manufacturing process of the same, requires the claimed matter in the following claims; such structures shall be covered within the scope of the invention.

It should be noted and understood that there can be improvements and modifications made of the present invention described in detail above without departing from the spirit or scope of the invention as set forth in the accompanying claims.

What is claimed is:

1. A method of mixed-paradigm parallel programming computerized simulation in a computer platform of shared and distributed memory parallel computers of component compositional variables of oil and gas phases of component hydrocarbon fluids of a giant subsurface reservoir to simulate performance and production from the reservoir, the giant subsurface reservoir being simulated by a model partitioned into a number of cells arranged in a three-dimensional coordinate system of a plurality of horizontal layers of cells, each horizontal layer comprising a plurality of cells having horizontal lateral dimensions along first and second intersecting horizontal axes and vertical dimension along a vertical axis, the simulation being based on available geological and fluid characterization information for the cells and the reservoir, and comprising the highly-parallelized computer processing steps of:

(a) forming a computed measure of equilibrium compositions in a shared memory supercomputer of the computer platform for individual hydrocarbon species in the oil and gas phases of the component hydrocarbon fluids with Open MP parallelization of data regarding the component compositional variables in the number of cells in the giant reservoir along the first horizontal axis;

(b) forming a computed measure of equilibrium compositions in a distributed memory supercomputer of the computer platform for the individual hydrocarbon species in the oil and gas phases of the component hydrocarbon fluids with MPI parallelization of data regarding the component compositional variables in the number of cells in the giant reservoir along the second horizontal axis;

(c) forming a computed measure of species balance in the shared memory supercomputer of the computer platform for the individual hydrocarbon species in the oil and gas phases of the component hydrocarbon fluids in the number of cells in the giant reservoir along the first horizontal axis;

(d) forming a computed measure of species balance in the distributed memory supercomputer of the computer platform for the individual hydrocarbon species in the oil and gas phases of the component hydrocarbon fluids in the number of cells in the giant reservoir along the second horizontal axis;

(e) forming a computed measure of water balance for water component fluid in the number of cells in the giant reservoir;

(f) forming a total volume balance to confirm that the total computed measures of species balance for the individual hydrocarbon species in the oil and gas phases of the component hydrocarbon fluids and the computed measure of water balance for the water component fluid in the number of cells in the giant reservoir does not exceed a saturation of one;

(g) determining residuals for the computed measures of equilibrium compositions and species balance for the individual hydrocarbon species in the oil and gas phases of the component hydrocarbon fluids in the number of cells in the giant reservoir;

(h) updating a solution vector based on the determined residuals for the computed measures of equilibrium compositions and species balance for the individual hydrocarbon species in the oil and gas phases of the component hydrocarbon fluids in the number of cells;

(i) determining if the residuals for the equilibrium compositions and species balance for individual hydrocarbon species of the oil and gas phases of the component hydrocarbon fluids in the number of cells are within a level of user-prescribed tolerances; and, (j) if not, repeating steps (a) through (i) based on the updated solution vector; or (k) if so, forming an output display of the component compositional variables of the individual hydrocarbon species of the oil and gas phases of the cells at desired locations in the giant subsurface reservoir to simulate performance and production from the giant reservoir.

2. The method of claim 1, wherein steps (a) through (k) are performed at a time of interest during production from the giant subsurface reservoir.

3. The method of claim 2, further including the step of performing steps (a) through (k) for a new time of interest.

4. The method of claim 2, further including the step of:

forming a record of the component compositional variables for the computed measures of individual hydrocarbon species of the component hydrocarbon fluids within the user-prescribed tolerance at the same time of interest.

5. The method of claim 4, wherein the component compositional variables for the component hydrocarbon fluids comprise fluid pressure of the individual hydrocarbon species of the component hydrocarbon fluids in the cells.

6. The method of claim 4, wherein the component compositional variables for the component hydrocarbon fluids comprise saturation of the individual hydrocarbon species of the component hydrocarbon fluids in the cells.

7. The method of claim 4, wherein the component compositional variables for the component hydrocarbon fluids comprise mole fraction of the individual hydrocarbon species of the component hydrocarbon fluids in the cells.

8. The method of claim 1, further including the step of:

computing initial measures of distribution of the component hydrocarbon fluids and the water component fluid in the giant reservoir.

9. The method of claim 1, further including the step of:

computing pore volume of the cells in the giant reservoir.

10. The method of claim 1, further including the step of:

computing rock transmissibility of the cells in the giant reservoir.

11. The method of claim 1, wherein the computer processing steps for the cells along the first horizontal axis for each of the layers are performed in a shared-memory supercomputer.

12. The method of claim 11, wherein the computer processing steps for the cells along the second horizontal axis for each of the layers are performed in a distributed memory supercomputer.

13. The method of claim 1, further including the steps of:

determining a fugacity coefficient for the individual hydrocarbon species in the oil and gas phases of each of the component hydrocarbon fluids in each of the number of cells in the giant reservoir;

determining a mole fraction for the individual hydrocarbon species in the oil and gas phases of the component hydrocarbon fluids in each of the number of cells in the giant reservoir; and during the steps of forming a computed measure of equilibrium compositions, maintaining equality between a product of fugacity coefficient and mole fraction for the individual hydrocarbon species in the oil and gas phases of the component hydrocarbon fluids.

14. The method of claim 1, further including the step of:

during the steps of forming a computed measure of equilibrium compositions, determining densities and fugacity coefficients for both liquid and vapor phases of the individual hydrocarbon species of the component hydrocarbon fluids based on an equation of state relationship for behavior of the component hydrocarbon fluids.

15. The method of claim 1, wherein the giant subsurface reservoir model is partitioned into cells of adequate mesh with spatial resolution and geological and engineering accuracy.

16. The method of claim 1, wherein the giant subsurface reservoir has lateral dimensions of a plurality of miles.

17. The method of claim 1, wherein each cell has horizontal lateral dimensions along the first and the second horizontal axis of eighty feet and vertical dimensions along the vertical axis of fifteen feet.

* * * * *